United States Patent [19]

Nordmeyer et al.

[11] Patent Number: 4,842,026

[45] Date of Patent: Jun. 27, 1989

[54] MACHINE FOR FILLING RECEPTACLES WITH FLOWABLE MATERIALS AND METHOD OF CLEANING THE MACHINE

[75] Inventors: Manfred Nordmeyer; Helmut Grüne, both of Schwarmstedt, Fed. Rep. of Germany

[73] Assignee: Lieder-Maschineabu GmbH & Co. KG, Schwarmstedt, Fed. Rep. of Germany

[21] Appl. No.: 801,796

[22] Filed: Nov. 26, 1985

[30] Foreign Application Priority Data

Nov. 29, 1984 [DE] Fed. Rep. of Germany ..... 3443557

[51] Int. Cl.[4] ..... B65B 3/04

[52] U.S. Cl. ..... 141/1; 141/90; 141/91; 141/258; 222/148; 137/246

[58] Field of Search ..... 141/1, 89–90, 141/98, 85, 116, 129, 146, 147, 249, 250, 258, 242; 222/148, 149, 302; 137/246, 246.11, 237, 625.21, 625.23, 625.46; 251/208

[56] References Cited

U.S. PATENT DOCUMENTS

| | | | |
|---|---|---|---|
| 2,107,987 | 2/1938 | Johnson | 141/116 X |
| 2,321,994 | 6/1943 | Chapman | 141/146 X |
| 2,666,564 | 1/1954 | Minard | 141/142 |
| 3,926,229 | 12/1975 | Scholle | 141/1 |
| 3,991,797 | 11/1976 | Uth et al. | 141/91 |
| 4,273,263 | 6/1981 | Voegele et al. | 141/91 |
| 4,318,431 | 3/1982 | Evans | 141/90 |
| 4,373,560 | 2/1983 | Elsworth | 141/129 |
| 4,457,398 | 7/1984 | Mueller et al. | 141/1 |
| 4,667,709 | 5/1987 | Fischer et al. | 441/91 |

FOREIGN PATENT DOCUMENTS

| | | | |
|---|---|---|---|
| 1140121 | 11/1962 | Fed. Rep. of Germany | 141/116 |

*Primary Examiner*—Ernest G. Cusick
*Attorney, Agent, or Firm*—Peter K. Kontler

[57] ABSTRACT

A machine for transferring metered quantities of viscous materials from a source of such materials into successive receptacles has a tubular housing with inlets and outlets disposed diametrically opposite each other. The housing confines a rotary metering device having an axially extending chamber and an opening which communicates with the inlet in one angular position and with the outlet in another angular position of the metering device. A piston in the metering device draws flowable material from the source into the chamber in the first angular position and expels such material from the chamber into a receptacle in the second angular position of the metering device. The housing and the metering device have adjacent frustoconical surfaces and the metering device is movable axially to establish between such surfaces a frustoconical clearance for admission of a liquid or gaseous cleaning fluid while the metering device remains in the interior of the housing. Additional cleaning fluid can be admitted into the metering device in the region of its opening as well as into the inlet of the housing.

52 Claims, 5 Drawing Sheets

MACHINE FOR FILLING RECEPTACLES WITH FLOWABLE MATERIALS AND METHOD OF CLEANING THE MACHINE

CROSS-REFERENCE TO RELATED CASE

An apparatus which can be used to transport receptacles to be filled with flowable material in the machine of the present invention is disclosed in the commonly owned copending application Ser. No. 767,410 filed Aug. 20, 1985 now U.S. Pat. No. 4,778,045, issued Oct. 18, 1988.

BACKGROUND OF THE INVENTION

The invention relates to a method and to a machine for tranferring metered quantities of flowable material (such as yoghurt, jam, marmalade, honey or other pasty substances) from a source into discrete receptacles, e.g., into cups or jars.

It is already known to provide a metering machine with a hollow rotary metering device which accepts a predetermined quantity of viscous material in one of its angular positions and delivers such quantity to a receptacle in a second angular position. The interior of the metering device is automatically sealed from the source of viscous material as a result of rotation of the metering device from its first position, and such interior is automatically sealed from the outlet of the machine when the metering device leaves its second position. The metering device must be a tight fit in the housing of the machine in order to reduce the likelihood of wobbling and particularly the likelihood of penetration of flowable material between the housing and the metering device. As a rule, or in many instances, the material is fed into the metering device at an elevated pressure so that it invariably penetrates between the metering device and the adjacent parts of the machine. This creates problems when the material contains softer (less viscous) and harder ingredients, such as yoghurt and pieces of fruit therein, because the harder ingredients cannot be readily removed from narrow gaps between the parts of the machine. This entails pronounced contamination of the machine, especially of the metering device, and the need for extensive and long-lasting cleaning after each use and particularly prior to admission of a different flowable material into the machine. This results in undesirable reduction of the output due to the length of periods of idleness for dismantling, cleaning and reassembly of component parts.

OBJECTS AND SUMMARY OF THE INVENTION

An object of the invention is to provide a novel and improved method of manipulating a machine for transferring metered quantities of flowable material in such a way that the periods of idleness are reduced to a fraction of those which must be accepted when using a conventional machine.

Another object of the invention is to provide a novel and improved method of assembling the machine so that the latter can be readily and thoroughly cleaned within a short period of time and without necessitating removal of the metering device from its housing.

A further object of the invention is to provide a method which renders it possible to transfer different flowable materials with short interruptions between the completion of transfer of a first material and the start of transfer of a different second material.

An additional object of the invention is to provide a novel and improved machine for the practice of the above outlined method.

A further object of the invention is to provide a machine whose parts need not be taken apart for the purpose of cleaning and which can be cleaned within a fraction of the time that is required to complete such operation in connection with conventional machines employing a rotary metering device.

Still another object of the invention is to provide the machine with a novel and improved housing as well as with a novel and improved metering device.

An additional object of the invention is to provide the machine with novel and improved means for promoting the admission of flowable material into and its evacuation from the metering device.

A further object of the invention is to provide a readily convertible machine which can be cleaned, either automatically or in a partly automated way, at any desired intervals and whose parts need not be machined with minimal tolerances because the cleaning operation can entail a rapid and effective removal of soft and/or harder substances while the metering device remains in its housing.

Another object of the invention is to provide a metering machine which can be utilized for tranferring selected quantities of a wide variety of flowable materials having a low, very low, high or extremely high viscosity.

One feature of the invention resides in the provision of a method of transferring metered quantities of flowable material from a source of such material to a succession of receptacles or to a single receptacle with a machine wherein a hollow metering device is movable with reference to a housing. The method comprises the steps of repeatedly moving the metering device with reference to the housing between a first position in which the metering device accepts flowable material from the source and a second position in which the thus accepted material is ready to enter a receptacle, and periodically cleaning the housing and the metering device while the latter remains in the housing. The moving step preferably comprises rotating the metering device between the first and second positions. The metering device has a plurality of surfaces which are contacted by flowable material in the first and second positions as well as during rotation between the first and second positions, and the cleaning step comprises contacting such surfaces of the metering device with a cleaning fluid which is conveyed through the housing. The method further comprises the step of establishing between the housing and the metering device a clearance prior to the cleaning step, and the latter preferably comprises forcing the cleaning fluid to flow through the clearance at an elevated pressure. The method preferably also comprises the step of increasing the width of the clearance for the duration of the cleaning step. The metering device is preferably rotatably journalled in the housing, and the increasing step then comprises moving the metering device axially with reference to the housing and/or vice versa.

The method preferably further comprises the steps of establishing a pressure differential between the source and the interior of the hollow metering device in the first position of the metering device to thus induce the flow of flowable material into the metering device, and establishing a pressure differential between the interior of the metering device and a receptacle in the second position of the metering device to thus induce the flow of flowable material from the metering device into the receptacle. Each of the pressure differential establishing steps preferably includes sealingly installing in the metering device a piston and moving the piston relative to the meeting device in the first position of the metering device to thereby draw flowable material into the metering device and to expel flowable material from the interior of the metering device in the second position of the latter.

The step of establishing a pressure differential between the source and the interior of the metering device can comprise raising the pressure in the source above the pressure in the interior of the metering device.

The metering device has an internal chamber and at least one opening which communicates with the internal chamber. The moving step then includes aligning the opening with the source in the first position of the metering device and aligning the same opening with a receptacle in the second position of the metering device. Alternatively, and if the metering device has two discrete openings, the moving step can include aligning one of the openings with the source in the first position and aligning the other opening with a receptacle in the second position of the metering device.

The aforementioned piston can be used to perform the step of expelling flowable material from the interior of the metering device in the second position of the latter by raising the pressure in the interior of the metering device.

The moving step can include continuously or intermittently moving the metering device between its first and second positions.

The interior of the metering device can constitute a chamber one end portion of which forms a compartment into which the piston is drawn for the duration of the cleaning step. The latter then comprises contacting the piston with a cleaning fluid in the compartment wherein the piston is received with a predetermined radial clearance.

Another feature of the invention resides in the provision of a machine for treating a flowable material (e.g., a viscous foodstuff). The machine comprises a suitable source of flowable material, a housing having an inlet adjacent to the source and an outlet, a rotary metering device installed in the housing and having an internal chamber and at least one opening communicating with the chamber, means for moving the metering device axially with reference to and within the housing between first and second axial positions, means for rotating the metering device (while the metering device is held in the first axial position) with reference to the housing between a first angular position in which the opening communicates with the inlet and a second angular position in which the opening communicates with the outlet, and means for cleaning the metering device in the second axial position of the latter.

The housing and the metering device respectively have internal and external surfaces which are closely adjacent to each other in the first axial position and which define a clearance in the second axial position of the metering device, and the cleaning means comprises means for conveying a cleaning fluid through the clearance. The housing preferably constitutes the body and the metering device then constitutes the valving element of a rotary of slide valve.

The inlet of the housing has at least one first aperture and the outlet of the housing has at least one second aperture. The opening of the metering device is in register with the first aperture in the first angular position and with the second aperture in the second angular position of the metering device. The metering device can be provided with a single opening which respectively registers with the first and second apertures in the first and second angular positions of the metering device.

The chamber of the metering device preferably includes a substantially cylindrical portion and a flow promoting second portion (which can resemble an elbow) extending between the opening of the metering device and the cylindrical portion. The second portion of the chamber can include a first part which extends substantially axially of the metering device and communicates with the cylindrical portion of the chamber, and a second part which extends substantially radially of the metering device and communicates with the opening.

The machine preferably further comprises a piston which is installed in the chamber and means for reciprocating the piston in the axial direction of the metering device so that the piston draws flowable material from the source into the chamber by way of the opening in the first angular position of the metering device and that the piston expels flowable material from the chamber by way of the opening in the second angular position of the metering device. The piston preferably comprises a circumferentially extending seal which engages an internal surface of the metering device at least during a predetermined stage of axial movement of the piston relative to the metering device.

The rotating means can comprise a piston rod which is connected to the piston and extends from the metering device. The piston rod preferably includes a portion having an outline deviating from a circular outline, and the metering device then comprises an end wall having an internal surface which is complementary to and surrounds the aforementioned portion of the piston rod so that the metering device and its end wall are compelled to share all angular movements of the piston rod. The rotating means then further comprises means for rotating the piston rod about the axis of the metering device so that the aforementioned portion of the piston rod transmits torque to the metering device. The aforediscussed portion of the piston rod can have a square, a rectangular or another polygonal outline. It will be seen that the means (piston rod) for reciprocating the piston can constitute or form part of the means for rotating the metering device relative to the housing.

The metering device can be provided with a circumferentially extending external groove and the moving means can include at least one projection (e.g., a ring-shaped collar) extending into the groove. Such metering device is preferably provided with two axially spaced-apart radially extending shoulders which flank the groove and the projection of the moving means.

The aforediscussed external and internal surfaces of the metering device and housing are preferably conical surfaces which define a substantially frustoconical clearance in the second axial position of the metering device. The latter is preferably elongated and the aforementioned opening is preferably provided at one end of the metering device. The diameters of the external and internal surfaces preferably increase in a direction from the one toward the other end of the elongated metering device. The metering device can further comprise a cylindrical external surface, and the housing is then provided with a cylindrical internal surface which surrounds and centers the cylindrical external surface in each axial position of the metering device. The one end of the metering device can constitute a relatively short cylinder whose external surface constitutes the aforementioned cylindrical external surface. The cylinder is rotatably journalled in the housing in each axial position of the metering device.

The housing can comprise a friction bearing which defines the cylindrical internal surface, i.e., which surrounds the cylinder of the metering device and is preferably adjacent to the inlet and the outlet of the housing.

The housing can include an elongated tube and a closure or plug for one end of the tube. The metering device is then provided with a recess at its one end, and such recess receives a preferably cylindrical centering portion of the closure. The centering portion preferably extends into the recess in each axial position of the metering device. The closure is preferably further provided with a shoulder which abuts against the end face at the one end of the metering device in the first axial position of the metering device. At least that portion of the closure which defines the shoulder can consist of a suitable bearing metal.

Alternatively, the metering device can have a closed cylindrical end portion which is rotatable in an annular friction bearing of the tube in each axial position of the metering device. The closure is then a plug having a cylindrical portion extending into one end of the friction bearing.

The other end of the metering device is preferably open and the machine then further comprises an apertured end wall for the open end of the metering device as well as means for securing the end wall to the metering device. The opening of the metering device is preferably remote from such end wall which latter allows for insertion of the aforementioned piston into or its withdrawal from the internal chamber of the metering device.

The cleaning means can comprise a manifold having a plurality of outlet means for admission of a cleaning fluid into the housing, and the metering device has a plurality of ports which admit cleaning fluid from one of the outlet means into the aforediscussed compartment of the chamber. The cleaning means can further comprise means for admitting a cleaning fluid into the housing in the region of the closure, preferably into the internal space of the housing at that end of the metering device which is provided with the opening. Additional part or parts of the cleaning means can admit cleaning fluid into the source or into the inlet of the housing.

One end portion of the metering device preferably extends from the housing, and such exposed end portion of the metering device is preferably connected with the moving means. The latter can comprise a projection (e.g., an inwardly extending annular collar) which is received in an external circumferentially extending groove between two radially extending shoulders of the metering device. As mentioned above, the means for rotating the metering device preferably comprises the piston rod of the piston which is reciprocable in the metering device, and a suitable device which rotates the piston rod, either back and forth or in a single direction.

The novel features which are considered as characteristic of the invention are set forth in particular in the appended claims. The improved machine itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
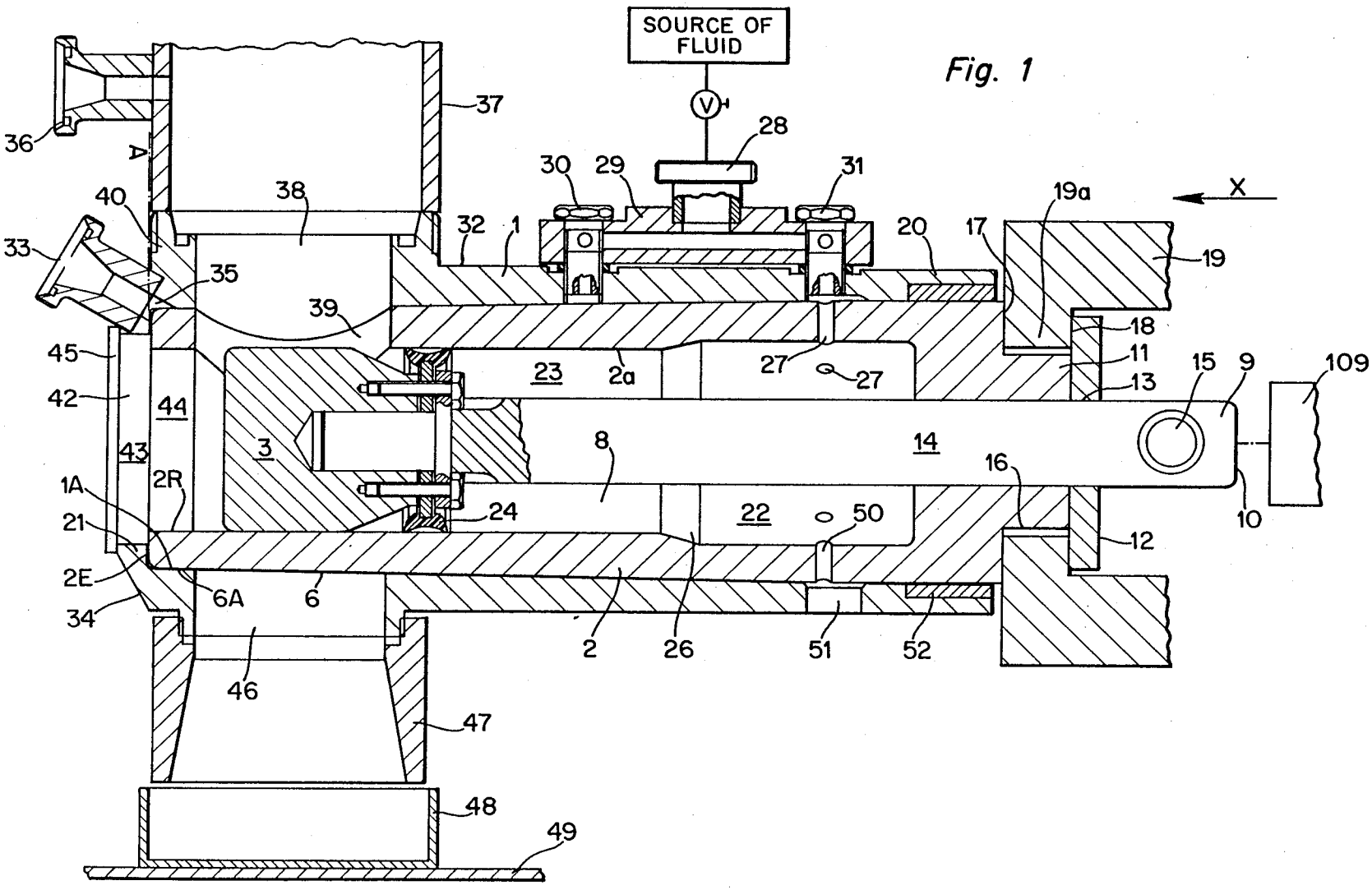
FIG. 1 is a longitudinal vertical sectional view of a machine which embodies one form of the invention, the metering device being shown in the first axial and angular positions and the piston being shown in a position it assumes prior to drawing flowable material into the interior of the metering device.
Figure 2:
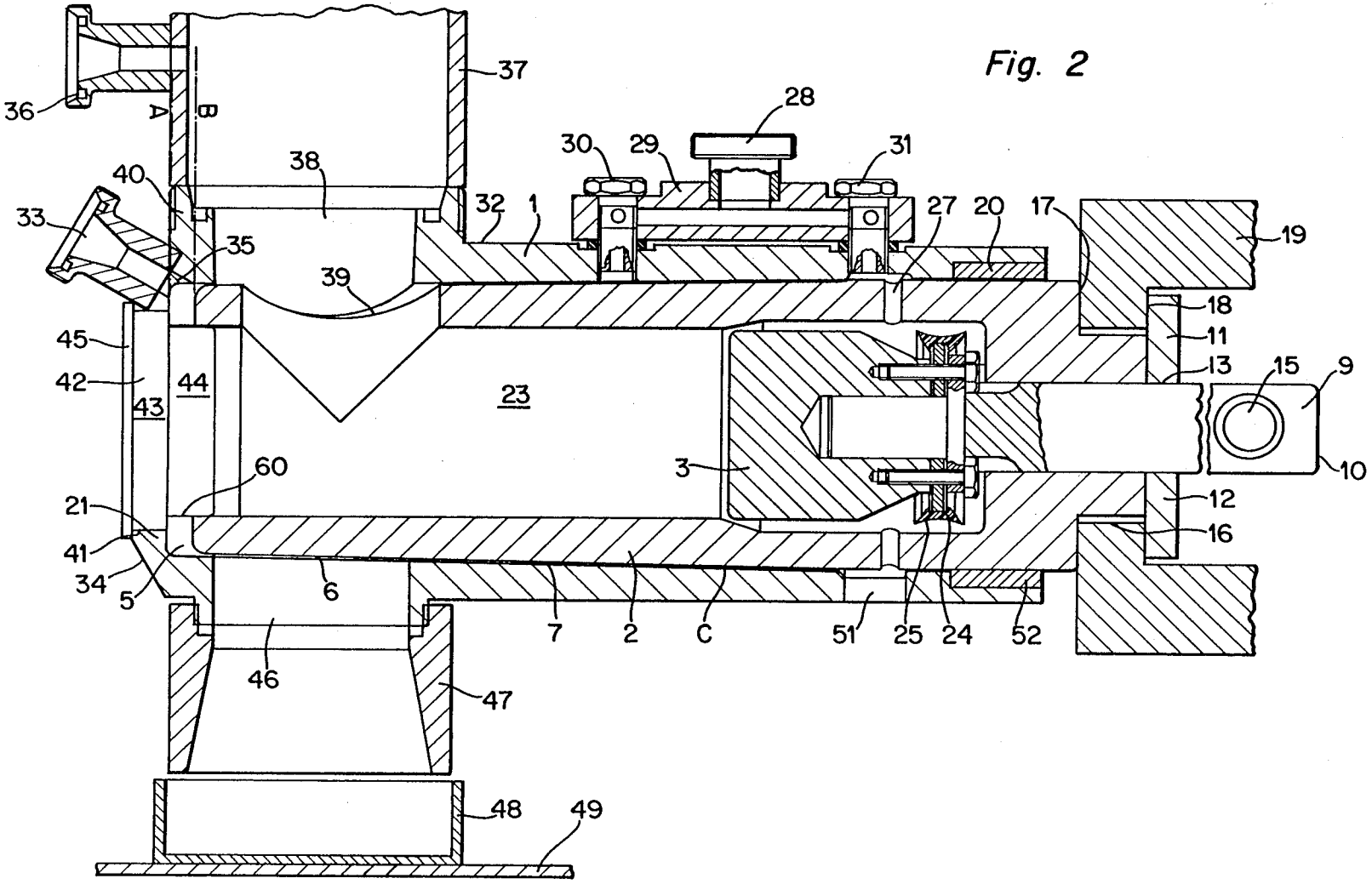
FIG. 2 shows the structure of FIG. 1 but with the metering device in the second axial position and the piston retracted into the enlarged portion of the chamber in the metering device.
Figure 3:
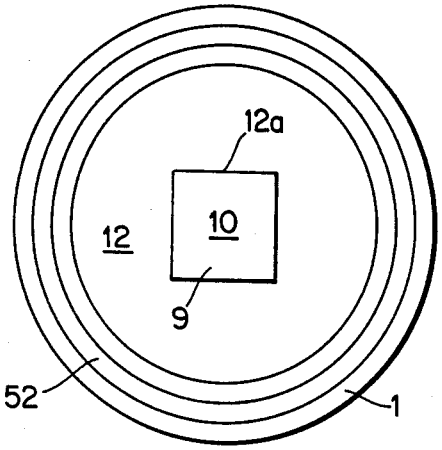
FIG. 3 is a rear elevational view as seen in the direction of arrow X in FIG. 1.

Referring first to FIGS. 1 to 3, there is shown a machine which serves to transfer metered quantities of a flowable material (e.g., yoghurt with pieces of fruit therein) from a source 37 to successive receptacles 48 (e.g., in the form of cups or jars) on an intermittently operated endless belt or other suitable conveyor 49. This conveyor may be of the type disclosed in the aforementioned commonly owned copending patent application Ser. No. 767,410 U.S. Pat. No. 4,778,045.

The improved machine comprises a housing 1 including an elongated tube and a closure or plug 42 at one axial end of the tube. The housing 1 can be said to constitute the body of a rotary slide valve whose valving element or spool is a rotary elongated hollow cylindrical metering device 2 having a axially extending internal chamber 8 for a reciprocable piston 3. The metering device 2 is not only rotatable but is also movable axially in the internal space 5 of the housing 1. FIG. 1 shows the metering device 2 in a first angular position in which an opening 39 at one end of the metering device communicates with an aperture of an inlet 38 which is provided in the housing 1 and communicates with the source 37. When the metering device 2 is rotated through 180 degrees, it assumes a second angular position in which its opening 39 is in register with an apertures of an outlet 46 forming part of the housing 1 and communicating with a downwardly extending duct or mouthpiece 47 which conveys metered quantities of flowable material from the internal chamber 8 into the adjacent receptacle 48 on the conveyor 49. The metering device 2 is further movable axially of the housing 1 between a first position which is shown in FIG. 1 and in which its frustoconical external surface 6 is immediately adjacent to the frustoconical internal surface 7 of the housing 1, and a second position (shown in FIG. 2) in which the surfaces 6 and 7 define a frustoconical clearance C. The internal surface 7 surrounds the space 5 in the housing 1.

The internal chamber 8 of the metering device 2 includes a cylindrical portion 23 one end of which communicates with the opening 39 and the other end of which communicates with an enlarged portion or compartment 22 serving to receive the piston 3 when the latter is held in the end position of FIG. 2, i.e., at a maximum distance from the opening 39.

Figure 5:
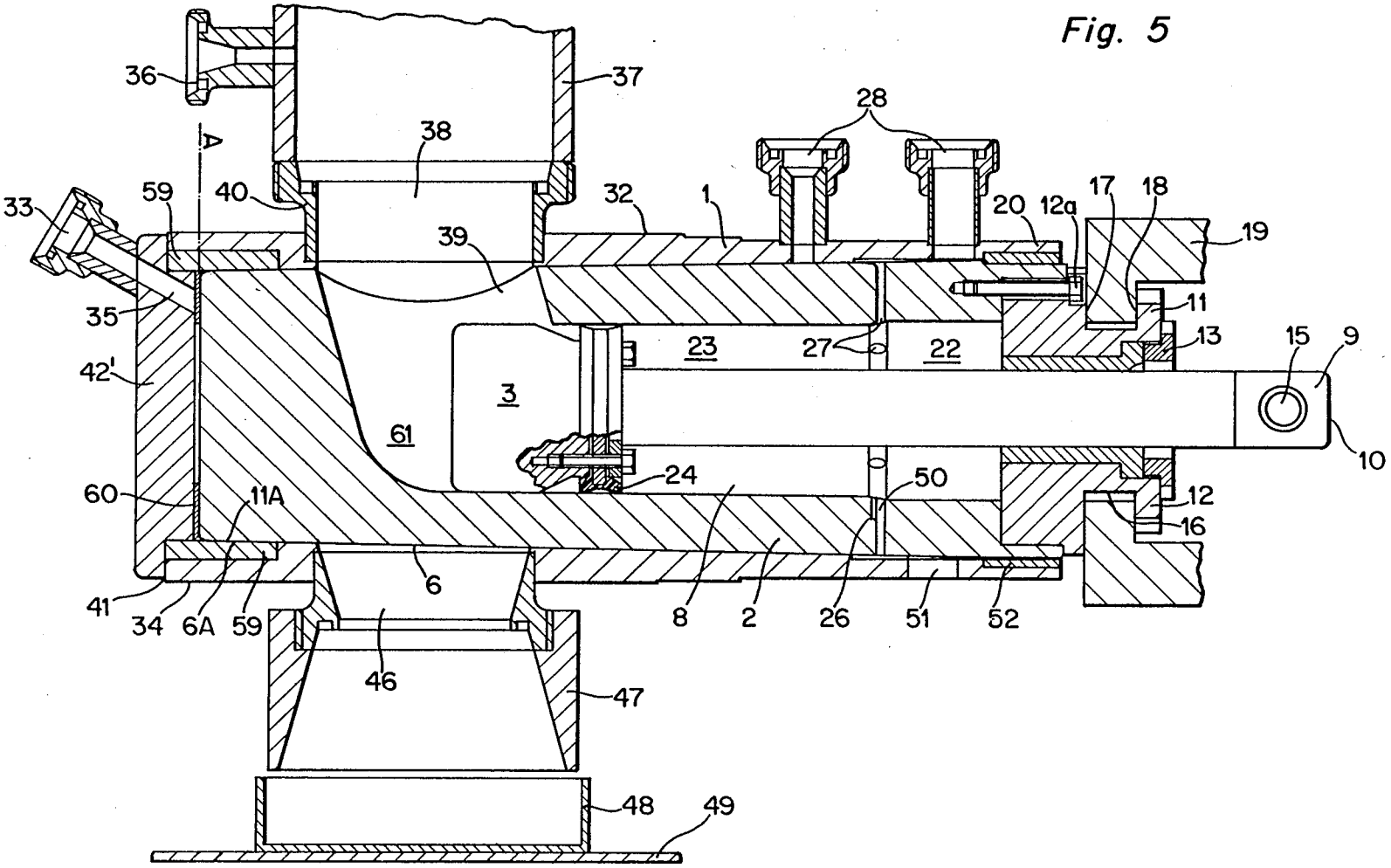
FIG. 5 is a longitudinal vertical sectional view of a third machine, with the metering device in the first axial and angular positions and the piston in a position prior to start of penetration of flowable material into the interior of the metering device.
Figure 6:
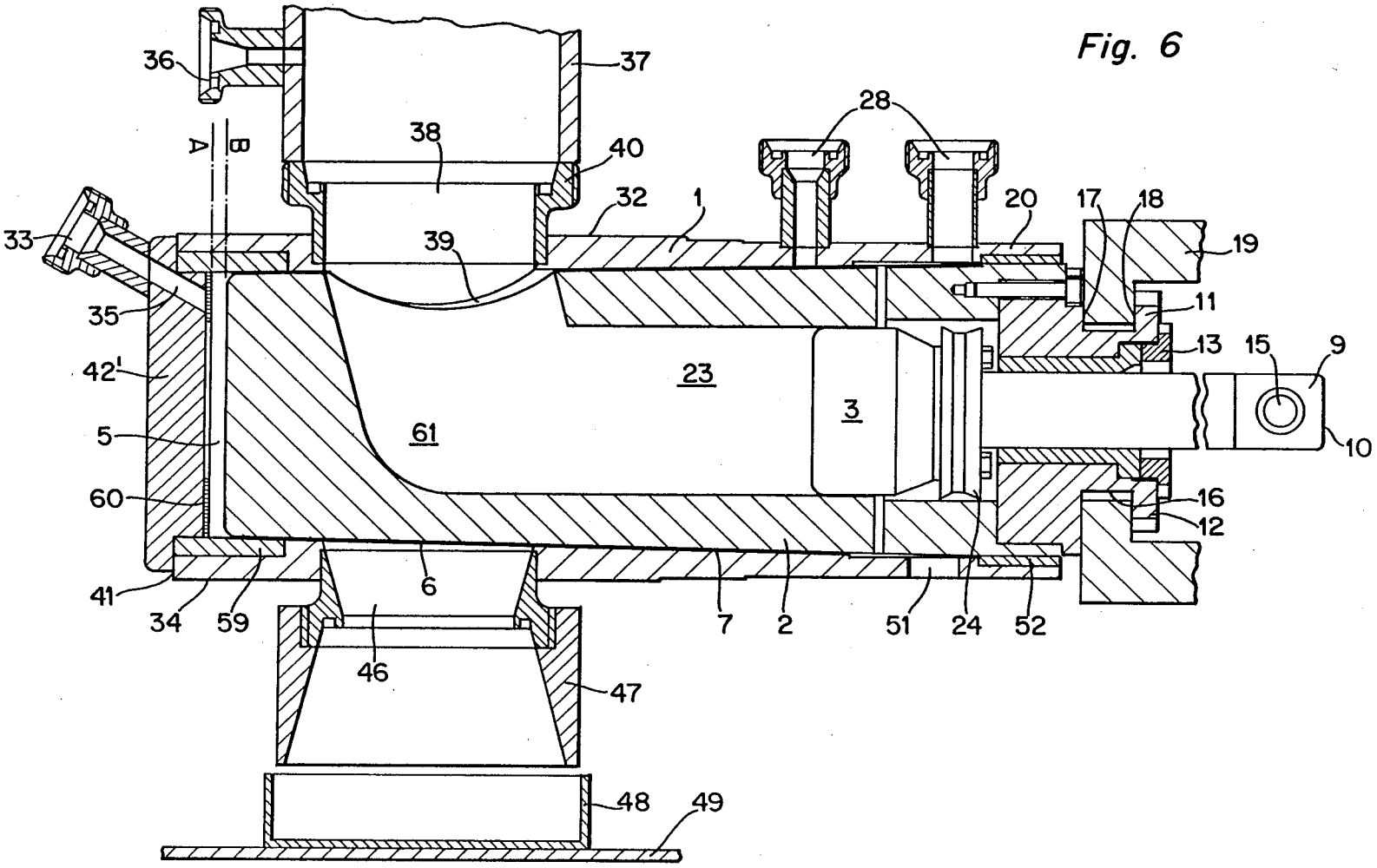
FIG. 6 shows the structure of FIG. 5 but with the piston in retracted position.

If desired, as as shown in FIGS. 5 and 6, the internal chamber 8 of the metering device 2 can further comprise a substantially L-shaped flow promoting portion 61 including a first part which extends substantially axially of the metering device and communicates with the cylindrical portion 22, and a second part which extends substantially radially of the metering device and communicates with the opening 39. The just discussed configuration of the chamber 8 is particularly desirable when the machine is used to transfer metered quantities of highly viscous materials. In many instances, the rather complex flow promoting portion 61 of the chamber 8 can be replaced with a simple radially extending bore which connects the cylindrical portion 23 with the opening 39.

The means for rotating the metering device 2 about its axis between the first angular position of FIGS. 1–2 and the other angular position (not specifically shown) comprises a piston rod 9 which is rigidly connected with or forms an integral part of the piston 3 and extends through a centrally located non-circular aperture 13 surrounded by a square internal surface 12*a* of an end wall 12 which can constitute a detachable part of the metering device so that it allows for insertion of the piston 3 into and for its removal from the housing 1. This can be seen in FIGS. 5 and 6 wherein the end wall 12 is separably secured to the major part of the metering device 2 by a set of bolts 12*a*, screws or other suitable fasteners.

The rear end portion 10 of the piston rod 9 extends from the housing 1 and metering device 2 and is coupled to a suitable means 109 (e.g., a continuously or intermittently driven gear, pulley or sprocket wheel) which serves to transmit torque to the piston rod 9 whereby the non-circular (e.g., square) portion 14 of the piston rod transmits torque to an annular portion 11 which forms part of the metering device 2. The means for moving the piston rod 9 and the piston 3 back and forth between the end positions of FIGS. 1 and 2 comprises a transverse pin 15 in a through hole or bore of the end portion 10 of the piston rod. The means for moving the piston rod 9 axially and for rotating the piston rod can be modified in a number of ways without departing from the spirit of the invention. For example, the pin 15 can form part of a means for rotating and reciprocating the piston rod 9, or the pin 15 can form part of means for rotating the piston rod and the means 109 then forms part of or constitutes an arrangement (e.g., a fluid-operated cylinder and piston unit) for reciprocating the piston rod relative to the metering device.

The rear end portion of the metering device 2 has a circumferentially extending external groove 16 which is flanked by two axially spaced-apart radially extending shoulders 17, 18 (one of these shoulders can be defined by the detachable end wall 12). The groove 16 receives a preferably collar-shaped projection 19*a* of a means 19 for moving the metering device 2 axially between the positions of FIGS. 1 and 2. The moving means 19 can form part of a fluid-operated motor which can shift the metering device 2 axially when the need arises, i.e., for periodic cleaning of the housing 1, metering device 2 and piston 3. The moving means 19 can constitute an adapter which connects the metering device 2 with a fluid-operated motor, a rack and pinion drive or any other suitable means for moving the device 2 axially between the positions of FIGS. 1 and 2. The groove 16 is provided in that portion (11) of the metering device 2 which extends from the rear end portion 20 of the tube of the housing 1. The diameters of the conical surfaces 6 and 7 decrease in a direction from the rear end portion 20 of the housing 1 toward the inlet 38 and outlet 46, i.e., toward that end of the metering device 2 which is provided with the opening 39 and is adjacent to the closure 42 of the housing. That (front) end portion of the tube forming part of the housing 1 which receives the closure 42 is denoted by the character 21.

The diameter of the surface surrounding the larger-diameter portion 22 of the chamber 8 defines with the peripheral surface of the piston 3 a rather large clearance (see FIG. 2) when the piston is retracted into the portion 22 by the piston rod 9 preparatory to start of a cleaning operation. The piston 3 comprises a circumferential seal 24 which engages the surface 2*a* surrounding the cylindrical portion 23 of the chamber 8 while the piston 3 performs predetermined portions of its forward and return strokes, namely while the piston is remote from the enlarged portion or compartment 22. The purpose of the piston 3 is to establish a pressure differential while moving away from the opening 39 (in the first angular position of the metering device 2) so as to draw or suck flowable material from the source 37, through the inlet 38, through the opening 39 and into the cylindrical portion 23 of the chamber 8, as well as to create a pressure differential during its forward movement toward the opening 39 in the second angular position of the metering device 2 so that a metered quantity of such material is forcibly expelled from the cylindrical portion 23 of the chamber 8 via opening 39, outlet 46, duct 47 and into the empty receptacle 48 on the conveyor 49. The external surface 25 of the seal 24 on the piston 3 ensures that the piston can draw metered quantities of flowable material into, and that the piston can expel metered quantities of such material from, the cylindrical portion 23 of the chamber 8 when the machine is in actual use. The clearance between the surface 25 and the internal surface 2*a* is zero but the seal 24 is readily slidable along the internal surface 2*a* in response to axial movement of the piston rod 9 in a direction to the right or to the left, as viewed in FIGS. 1 and 2.

The reference character 26 denotes a transition zone wherein the inner diameter of the metering device 2 increases gradually or abruptly from that of the surface 2*a* to the diameter of the surface surrounding the compartment 22. That portion of the metering device 2 which surrounds the compartment 22 is formed with several radially extending ports 27 forming part of the means for cleaning the housing 1, metering device 2 and piston 3 of the improved machine without even partial dismantling of the machine, i.e., while the metering device remains in the housing. The means for cleaning further comprises a nipple 28 which is permantly connected or which can be connected to a source of compressed gaseous and/or hydraulic cleaning fluid for the components 1, 2 and 3 of the machine. The nipple 28 is threadedly or otherwise connected to a manifold 29 having several outlets 30, 31 for admission of pressurized cleaning fluid into the clearance C when the metering device 2 is held in the axial position of FIG. 2. The manifold 29 is adjacent to the external surface 32 of the housing 1. The outlet 30 of the manifold 29 is or can be located substantially midway between the ends of the internal space 5 of the housing 1.

The cleaning device comprises a second nipple 33 which is installed at the front end 21 of the housing 1 at a level above an annular portion 34 which forms part of or constitutes the outlet 46. The nipple 33 can admit a cleaning fluid into a port or channel 35 which communicates with the space 5 in the region of the closure 42. A third nipple 36 is provided on the source 37 to admit cleaning fluid into the inlet 38 when the machine is ready for cleaning. Such fluid enters the chamber 8 of the metering device 2 by way of the opening 39 when the metering device is held in the angular position of FIG. 1 or 2. The inlet 38 is integral with or forms part of an annular portion 40 of the housing 1 at the latter's front end 21.

The front end 21 of the housing 1 is formed with an opening 41 which receives the larger-diameter portion 43 of the closure 42 whereby a smaller-diameter cylindrical centering portion 44 of the closure extends into the adjacent open end of the metering device 2. A radially extending shoulder of the portion 43 sealingly engages the adjacent end face 2E of the metering device 2. At least the portion 43 of the closure 42 can consist of a suitable bearing metal. The diameter of the opening 41 is less than the diameter of the adjacent portion of the internal space 5 in the housing 1. The closure 42 has a flange 45 which is outwardly adjacent to the portion 43 and abuts against the adjacent end face of the tube which forms part of the housing 1. The closure 42 is preferably designed to establish a fluidtight seal for the front end 21 of the housing 1. The cylindrical peripheral surface 60 of the centering portion 44 is sealingly received in the recess 2R which is formed in the open front end of the metering device 2, and the cylindrical surface 60 is in contact with the adjacent cylindrical surface surrounding the recess 2R in each axial position of the metering device 2. The latter further comprises a cylindrical external surface 6A which is in continuous contact with the adjacent cylindrical internal surface 1A of the housing 1 in each axial position of the metering device. It will be seen that the cylindrical surfaces 1A and 6A are located forwardly of the smaller-diameter ends of the frustoconical surfaces 7 and 6, respectively.

The shoulder of the portion 43 of the closure 42 ensures that the metering device 2 cannot move to the left and beyond the axial position of FIG. 1 when the machine is in actual use, i.e., when the metering device is rotated (either continuously or intermittently) between the two angular positions in one of which the opening 39 can admit flowable material from the source 37 into the cylindrical portion 23 of the chamber 8 and in the other of which such material can be expelled from the chamber 8 to enter the adjacent receptacle 48. The shoulder of the portion 43 further determines the width of the clearance between the frustoconical surfaces 6 and 7 when the machine is ready for use. A minimal clearance between the surfaces 6 and 7 is desirable and necessary, even in the axial position of the metering device which is shown in FIG. 1, in order to reduce the likelihood of jamming of the metering device 2 and/or excessive wear upon the surfaces 6 and 7.

The aperture of the inlet 38 of the housing 1 is located diametrically opposite the aperture of the outlet 46. The opening 39 and the apertures of the inlet 38 and outlet 46 may but need not necessarily have a circular shape.

The operation is as follows:

The source 37 contains a normally viscous pasty substance which flows by gravity into the inlet 38 and is ready to be drawn into the cylindrical portion 23 of the chamber 8 as soon as the metering device 2 assumes the angular position of FIG. 1 and the piston 3 begins its return stroke from the extended position of FIG. 1 toward the retracted position of FIG. 2. As a rule, the piston 3 will assume the fully retracted position of FIG. 2 only when the machine is ready for cleaning. The piston 3 establishes a pressure differential which causes the flowable material to readily penetrate into the chamber 8 and to fill such chamber all the way between the opening 39 and the front side of the piston. In the next step, the piston rod 9 is rotated through 180 degrees so as to move the opening 39 into register with the aperture of the outlet 46, and the piston rod 9 is then caused to move the piston 3 forwardly whereby a metered quantity of flowable material leaves the chamber 8 and is transferred into the receptacle 48 on the conveyor 49. The piston rod 9 is then rotated again so as to return the opening 39 into register with the aperture of the inlet 38, and the piston 3 is retracted to draw a further metered quantity of flowable material into the chamber 8. The same procedure is repeated again and again, and the angular movements of the metering device 2 are synchronized with axial movements of the piston 3 as well as with the stepwise movements of the conveyor 49 to ensure that each of a short or long series of receptacles 48 receives a metered quantity of flowable material. Of course, each receptacle can receive two or more metered quantities of flowable material, or a single receptacle can receive a large or very large number of successive metered quantities of flowable material.

The piston 3 contributes to a higher output of the machine because it renders it possible to rapidly fill the cylindrical portion 23 of the chamber 8 with flowable material as soon as the metering device 2 assumes the angular position of FIG. 1. Furthermore, the piston 3 and its seal 24 reduce the likelihood of premature and extensive contamination of the machine by preventing the flowable material from penetrating into the enlarged portion or compartment 22 of the chamber 8 in normal operation of the metering machine. Still further, the piston 3 promotes the expulsion of metered quantities of flowable material from the chamber 8 in successive second angular positions of the metering device.

In order to clean the machine, and particularly the housing 1, the metering device 2 and the piston 3, the moving means 19 is actuated to shift the metering device 2 axially to the position of FIG. 2 whereby the frustoconical surfaces 6 and 7 define the aforementioned frustoconical clearance C. The axial movement of the metering device 2 from the position of FIG. 1 to the position of FIG. 2 is relatively small, i.e., the width of the clearance C need not be very pronounced but should suffice to allow for rapid and thorough cleaning with a pressurized fluid medium, such as water. The front end face 2E of the metering device moves from the plane A to the plane B (the plane A is shown in each of FIGS. 1–2 and the plane B is shown in FIG. 2). The nipples 28, 33 and 36 admit cleaning medium at a requisite pressure to ensure a thorough cleaning of the surfaces 6 and 7. The nipple 36 admits fluid which cleans the surfaces in the regions of the inlet 38, opening 39 and chamber 8. The fluid which issues from the nipple 33 further cleans the parts of the machine in the region of the front end 21 of the housing 1. Some of the fluid which issues from the port or channel 35 also flows into the opening 39 to penetrate into the chamber 8.

During cleaning, the piston 3 is held in the retracted position of FIG. 2 so that the jets of cleaning fluid which enter the compartment 22 via ports 27 can thoroughly clean the piston, the seal 24, the adjacent end of the piston rod 9 as well as the surface surrounding the compartment 22. The width of the annular clearance between the piston 3 and seal 24 on the one hand and the surface surrounding the compartment 22 on the other hand is rather pronounced to thus allow for rapid and highly effective cleaning of such surfaces. The metering device 2 can be rotated during cleaning to ensure an even more reliable cleaning action. The cleaning fluid which has entered the compartment 22 via cylindrical portion 23 and/or ports 27 is evacuated by way of one or more outlet openings 50 which are provided in the metering device 2 and communicate with one or more outlet openings 51 in the housing 1, at least when the metering device 2 is held in the axial position of FIG. 2. The outlet openings 50 and 51 are inwardly adjacent to a friction bearing 52 which is recessed into the internal surface 7 of the housing 1 at the rear end 20.

The cleaning operation is completed after a preselected interval of time or when the operator in charge ascertains that all of the parts that come in contact with the flowable medium are sufficiently clean to resume the operation for the transfer of the same flowable material or to start with the transfer of metered quantities of a different flowable material. When the cleaning operation is completed, i.e., when the nipples 28, 33 and 36 cease to receive a pressurized cleaning fluid from the source, the moving means 19 is actuated to shift the metering device 2 from the axial position of FIG. 2 back to the axial position of FIG. 1.

As mentioned above, the piston rod 9 can have a square, rectangular or any other polygonal or non-polygonal outline which is complementary to the outline of the adjacent part of the end wall 12 in order to ensure that the metering device 2 shares the angular movements of the piston rod. Furthermore, the surfaces 6 and 7 of the metering device 2 and housing 1 need not be exactly frustoconical, as long as they define a satisfactory clearance in response to axial movement of the metering device relative to the housing and/or vice versa.

The friction bearing 59 of FIGS. 5 and 6 can be used in lieu of the plug 42 which is shown in FIGS. 1–2. The plug 42 is then replaced with a simpler plug 42' whose smaller-diameter end portion is sealingly received in the respective end of the friction bearing 59. The front end portion of the metering device 2 which is shown in FIGS. 5 and 6 is solid, i.e., the cylindrical surface 6A surrounds a solid cylindrical portion of the metering device which extends all the way to the flow promoting portion 61 of the chamber 8 in the metering device. Therefore, the flowable material cannot be used as a lubricant for the friction bearing 59. The friction bearing 59, the same as the friction bearing 52, is preferably made of a material exhibiting satisfactory self-lubricating properties.

The improved machine can be used with advantage for the transfer of metered quantities of flowable viscous materials. However, it is also possible to transfer metered quantities of low-viscosity materials by the simple expedient of providing the mouthpiece or duct 47 and the outlet 46 with sharply defined edges to thus ensure that the outflow of readily flowable material can be controlled with a requisite degree of accuracy. Furthermore, the just described machine can be used with advantage for the transfer of metered quantities of flowable materials which contain readily flowable ingredients as well as more or less solid ingredients, such as yoghurt and pieces of fruit therein.

Figure 4:
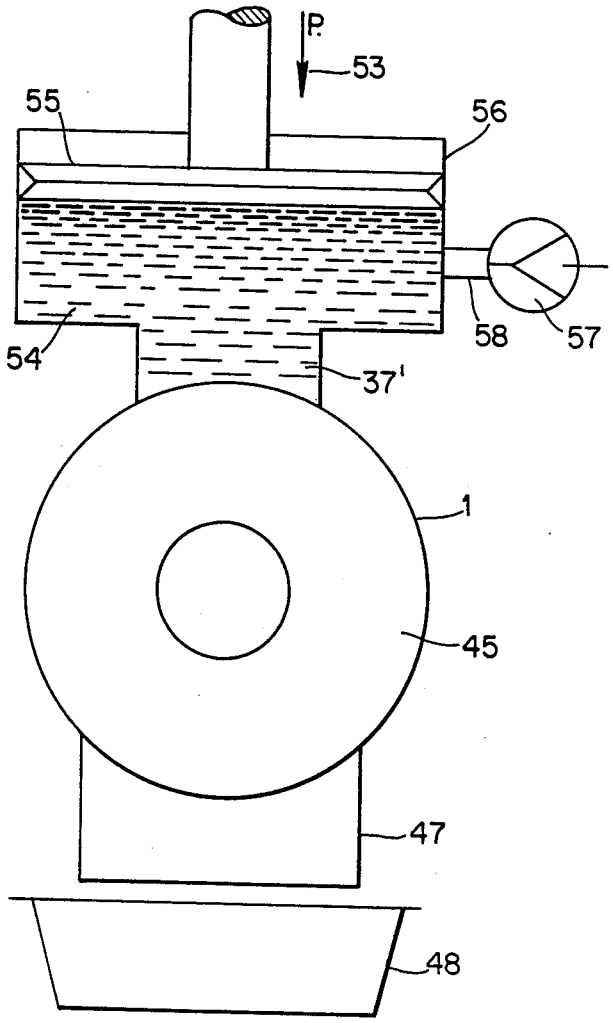
FIG. 4 is a front elevational view of a modified machine wherein the source of flowable material comprises a plenum chamber.

FIG. 4 shows that it is also possible to omit the plunger 3, or to use the plunger 3 with, a modified source 37' wherein a large-diameter plunger 55 in a cylinder 56 is used to maintain the flowable material under elevated pressure so that such material exhibits a pronounced tendency to rapidly fill the chamber 8 as soon as the opening 39 of the metering device 2 moves into register with the inlet 38 of the housing 1. The arrow 53 denotes the direction of application of a force P which is used to urge the plunger 55 downwardly in the upper part of the source 37. Flowable material 54 enters the source 37 by way of a conduit 58 which contains a regulating valve 57.

An important advantage of the improved machine and of the improved method is that the cleaning operation does not involve, and need not be preceded by, dismantling of the machine. In spite of this, the machine can be cleaned quite thoroughly and the cleaning medium or media can reach all affected parts of the machine. It has been found that the cleaning operation invariably results in the expulsion of all solid particles which happen to penetrate between the housing, metering device, piston and/or other parts of the machine. Still further, the machine is less likely to be assembled in an improper way because the cleaning operation is not preceded by the removal of the metering device and/or other parts. Heretofore, cleaning of the machine without any, even partial, dismantling was a very superficial operation which was not satisfactory prior to a shift from the transfer of a first type of material to the transfer of a different second type of material. The means for moving the metering device axially is simple and there is no need to provide additional bearings or the like since the metering device is movable in the housing anyway.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A method of transferring metered quantities of flowable material from a source to a succession of receptacles with a machine wherein a hollow metering device is movable with reference to a housing in a plurality of different directions, comprising the steps of repeatedly moving the metering device with reference to the housing in one of said directions between a first position in which the metering device accepts flowable material from the source and a second position in which the thus accepted material is ready to enter a receptacle; and periodically cleaning the housing and the metering device, while the latter remains in the housing, including displacing the metering device with reference to the housing in another of said directions.

2. The method of claim 1, wherein said moving step includes rotating the metering device in said one direction between said first and second positions.

3. The method of claim 2 of transferring flowable material with a machine wherein the metering device has a plurality of surfaces which are contacted by flowable material in said positions as well as during rotation between such positions, said cleaning step further comprising contacting the surfaces of the metering device with a cleaning fluid which is conveyed through the housing following a displacement of the metering device in said other direction.

4. The method of claim 3, wherein the housing has surfaces adjoining the surfaces of the metering device and further comprising the step of establishing between the adjoining surfaces of the metering device and the housing a clearance prior to said contacting step and in response to displacement of the metering device in said other direction, said contacting step including forcing the cleaning fluid to flow through such clearance.

5. The method of claim 4, further comprising the step of increasing the width of the clearance in the course of said contacting step.

6. The method of claim 5, wherein the metering device is rotatably journalled in the housing, said increasing step including displacing the metering device axially with reference to the housing in said other direction.

7. The method of claim 1, further comprising the steps of establishing a pressure differential between the source and the interior of the hollow metering device in the first position of the metering device to thus induce the flow of material into the metering device, and establishing a pressure differential between the interior of the metering device and a receptacle in the second position of the metering device to induce the flow of admitted material from the metering device into the receptacle.

8. The method of claim 7, wherein each of said pressure differential establishing step includes sealingly installing a piston within and moving it relative to the metering device so as to draw flowable material into the metering device in the first position of such metering device and to expel flowable material from the metering device in the second position of the metering device.

9. The method of claim 7, wherein said step of establishing a pressure differential between the source and the interior of the metering device comprises raising the pressure in the source above the pressure in the interior of the metering device.

10. The method of claim 1 of transferring flowable material with a machine wherein the metering device has an internal chamber and an opening communicating with such chamber, said moving step including aligning the opening with the source in the first position of the metering device and aligning the same opening with a receptacle in the second position of the metering device.

11. The method of claim 1, further comprising the step of expelling flowable material from the interior of the hollow metering device in the second position of the metering device including raising the pressure in the interior of the metering device.

12. The method of claim 1, wherein said moving step includes continuously rotating the metering device.

13. The method of claim 1, wherein said moving step includes intermittently rotating the metering device.

14. The method of claim 1 of transferring metered quantities of flowable material wherein a piston is sealingly and reciprocably installed in the interior of the metering device to draw flowable material into and to expel flowable material from the metering device in the first and second positions of such device and wherein the metering device defines a compartment wherein the piston is receivable with a predetermined amount of radial clearance, further comprising the step of moving the piston into the compartment for the duration of said cleaning step.

15. A machine for treating a flowable material, comprising a source of flowable material; a housing having an inlet adjacent to said source and an outlet; a rotary metering device installed in said housing and having an internal chamber and at least one opening communicating with said chamber; means for moving said device axially with reference to and within said housing between first and second positions, said housing and said device respectively having internal and external surfaces which are closely adjacent to each other in the first axial position and define a clearance in the second axial position of said device; means for rotating said device, in said first axial position thereof, with reference to said housing between a first angular position in which said at least one opening communicates with said inlet and a second angular position in which said at least one opening communicates with said outlet; and means for cleaning said device in said second axial position, including means for conveying a fluid through said clearance.

16. The machine of claim 15, wherein said housing and said metering device together constitute a rotary slide valve having a body including said housing and a valving element including said metering device.

17. The machine of claim 15, wherein said inlet has a first aperture and said outlet has a second aperture, said at least one opening being in register with said first aperture in the first angular position and with said second aperture in the second angular position of said metering device while the latter is held in said first axial position.

18. The machine of claim 17, wherein said metering device has a single opening which respectively registers with said first and second apertures in the first and second angular positions of said device.

19. The machine of claim 15, wherein said chamber includes a substantially cylindrical portion and a flow promoting second portion extending between said at least one opening and said cylindrical portion.

20. The machine of claim 19, wherein said second portion includes a first part extending substantially axially of said device and communicating with said cylindrical portion and a second part extending radially of said device and communicating with said at least one opening.

21. The machine of claim 15, further comprising a piston in said chamber and means for reciprocating said piston in the axial direction of said device so that the piston draws flowable material from the source via said at least one opening and into said chamber in the first angular position and expels flowable material from said chamber via said at least one opening in the second angular position of said device while the device is held in said first axial position.

22. The machine of claim 21, wherein said rotating means comprises a piston rod which is connected with said piston and extends from said metering device.

23. The machine of claim 22, wherein said piston rod includes a portion having an outline deviating from a circular outline and said metering device includes an end wall having an internal surface complementary to and surrounding said portion of said piston rod, said rotating means further comprising means for rotating said piston rod about the axis of said metering device so that said portion of said piston rod transmits torque to the metering device.

24. The machine of claim 23, wherein said portion of said piston rod has a polygonal cross-sectional outline.

25. The machine of claim 22, wherein said reciprocating means includes said piston rod.

26. The machine of claim 21, wherein said piston comprises a circumferentially extending seal and said metering device has an internal surface which is engaged by said seal at least during a predetermined stage of axial movement of said piston relative to said device.

27. The machine of claim 15, wherein said metering device has a circumferentially extending external groove and said moving means has at least one projection extending into said groove.

28. The machine of claim 27, wherein said metering device has two axially spaced-apart radially extending shoulders which flank said groove and said projection includes a collar which is disposed between said shoulders.

29. The machine of claim 15, wherein said surfaces are conical surfaces and define a substantially frustoconical clearance in the second axial position of said metering device.

30. The machine of claim 29, wherein said metering device is elongated and said opening is adjacent to one end of its ends, the diameters of said surfaces increasing in a direction from said one end toward the other end of said metering device.

31. The machine of claim 30, wherein said metering device comprises a cylindrical external surface at said one end thereof and said housing has a cylindrical internal surface surrounding said cylindrical external surface in each axial position of said metering device.

32. The machine of claim 31, wherein said one end of said metering device is a cylinder.

33. The machine of claim 31, wherein said housing comprises a friction bearing which defines said cylindrical internal surface.

34. The machine of claim 30, wherein said inlet and said outlet are adjacent to the one end of said metering device in the first axial position of said device and said one end constitutes a cylinder which is rotatably journalled in said housing in each axial position of said metering device.

35. The machine of claim 15, wherein said housing includes an elongated tube and a closure for one end of said tube.

36. The machine of claim 35, wherein said metering device is elongated and has a recess at one of its ends, said closure having a centering portion extending into said recess in each axial position of said device.

37. The machine of claim 36, wherein said one end of said metering device has an end face and said closure has a shoulder which is contacted by said end face in the first axial position of said device.

38. The machine of claim 37, wherein at least that portion of said closure which defines said shoulder consists of a bearing metal.

39. The machine of claim 35, wherein said metering device is elongated and has a cylindrical portion at one of its ends, and further comprising an annular friction bearing installed in said tube, said closure having a portion sealingly extending into said bearing and said cylindrical portion being rotatably journalled in said bearing in each axial position of said device.

40. The machine of claim 15, wherein said metering device is elongated and has an open end, and further comprising an apertured end wall and means for securing said end wall to the open end of said device.

41. The machine of claim 40, wherein said at least one opening is adjacent to the other end of said metering device.

42. The machine of claim 15, wherein said metering device is elongated and said at least one opening is located at one end of said device, said chamber having a cylindrical portion which is adjacent to and an enlarged portion which is remote from said one end, and further comprising a piston reciprocably installed in said chamber and means for reciprocating said piston in said cylindrical portion so that the piston draws flowable material into said chamber via said at least one opening in the first angular position and expels flowable material from said chamber via said at least one opening in the second angular position of said device while such device is held in the first axial position, said reciprocating means including means for moving the piston into said enlarged portion of said chamber so that the piston and the metering device then define an annular space surrounding said piston, said cleaning means including means for admitting a fluid into such annular space.

43. The machine of claim 42, wherein said metering device has at least one port which communicates with said enlarged portion of said chamber and said cleaning means includes means for admitting the fluid into said annular space by way of said port, said metering device further having at least one fluid evacuating outlet opening.

44. The machine of claim 43, wherein said housing has a second fluid evacuating opening which communicates with the fluid evacuating opening of said metering device in the second axial position of said metering device.

45. The machine of claim 15, wherein said cleaning means includes a manifold having a plurality of outlet means for admission of a cleaning fluid into said housing and said metering device has a plurality of ports for admission of cleaning fluid from one of said outlet means into said chamber.

46. The machine of claim 15, wherein said housing includes a tubular portion and a closure at one end of said tubular portion, said cleaning means having means for admitting a cleaning fluid into said housing in the region of said closure.

47. The machine of claim 46, wherein said housing defines for said metering device an internal space a portion of which is adjacent to said closure and receives cleaning fluid from said admitting means.

48. The machine of claim 15, wherein said cleaning means comprises means for admitting a cleaning fluid into said inlet in the region of said source.

49. The machine of claim 15, wherein said metering device has a first end portion which is provided with said at least one opening and a second end portion which extends from said housing.

50. The machine of claim 49, wherein said moving means is connected with the second end of said metering device.

51. The machine of claim 50, wherein the second end of said metering device has a circumferentially extending external groove and two radially extending shoulders flanking said groove, said moving means including a projection which extends into said groove and is flanked by said shoulders.

52. The machine of claim 15, wherein said means for rotating said metering device comprises a piston which is reciprocable in said chamber and has a piston rod extending from and non-rotatably installed in said metering device, said rotating means further comprising means for rotating said piston rod.

* * * * *